US010260837B1

(12) United States Patent
McGinty

(10) Patent No.: US 10,260,837 B1
(45) Date of Patent: Apr. 16, 2019

(54) ADJUSTABLE FIREARM STOCK

(71) Applicant: FALKOR SID, Inc., Kalispell, MT (US)

(72) Inventor: Aaron A. McGinty, Kalispell, MT (US)

(73) Assignee: FALKOR SID, INC., Kalispell, MT (US)

( * ) Notice: Subject to any disclaimer, the term of this patent is extended or adjusted under 35 U.S.C. 154(b) by 0 days.

(21) Appl. No.: 15/497,248

(22) Filed: Apr. 26, 2017

Related U.S. Application Data

(60) Provisional application No. 62/328,642, filed on Apr. 28, 2016.

(51) Int. Cl.
*F41C 23/14* (2006.01)
*F41A 3/84* (2006.01)

(52) U.S. Cl.
CPC ..... *F41C 23/14* (2013.01); *F41A 3/84* (2013.01)

(58) Field of Classification Search
CPC ..... F41C 23/14; F41C 23/04
USPC ..... 42/73
See application file for complete search history.

(56) References Cited

U.S. PATENT DOCUMENTS 7,398,616 B1 * 7/2008 Weir ..... F41C 23/04 42/71.01
7,762,018 B1 * 7/2010 Fitzpatrick ..... F41A 11/02 42/73
8,127,483 B2 * 3/2012 Kincel ..... F41C 23/04 42/71.01
8,327,569 B2 * 12/2012 Kincel ..... F41C 23/04 42/71.01
8,397,414 B2 * 3/2013 Walters ..... F41C 23/04 42/71.01
8,434,252 B2 * 5/2013 Holmberg ..... F41A 3/84 42/1.06
8,468,729 B1 * 6/2013 Sylvester ..... F41A 3/84 42/1.01
D745,622 S * 12/2015 Zusman ..... D22/108
2010/0205846 A1 * 8/2010 Fitzpatrick ..... F41A 11/02 42/73
2010/0242333 A1 * 9/2010 Kincel ..... F41C 23/04 42/73
2011/0173863 A1 * 7/2011 Ingram ..... F41A 11/00 42/73
2011/0283584 A1 * 11/2011 Walters ..... F41C 23/04 42/73

(Continued)

*Primary Examiner* — Joshua E Freeman
(74) *Attorney, Agent, or Firm* — Bennet K. Langlotz; Langlotz Patent & Trademark Works, LLC

(57) ABSTRACT

An adjustable firearm stock has a frame having a forward extending barrel defining a barrel axis and defining an elongated passage adapted to receive a reciprocating bolt, the frame having a first attachment facility registered with the barrel axis and adapted to receive a buffer tube defining a cavity adapted to receive a buffer spring operable to interact with the bolt, the frame having second attachment facility spaced apart from the barrel axis and from the first attachment facility, a telescoping stock defining a sleeve bore coaxial with the barrel axis and closely and slidably receiving the buffer tube, the stock defining a second bore parallel to and laterally offset from the first bore, an elongated support element slidably received in the second bore, and the support element having a forward end operable to removably engage the second attachment facility.

18 Claims, 9 Drawing Sheets

(56) References Cited

U.S. PATENT DOCUMENTS

| | | | | |
|---|---|---|---|---|
| 2012/0204464 | A1* | 8/2012 | Kincel | F41C 23/04<br>42/73 |
| 2013/0097911 | A1* | 4/2013 | Larue | F41C 23/04<br>42/73 |
| 2013/0180148 | A1* | 7/2013 | Rogers | F41C 23/04<br>42/73 |
| 2015/0176944 | A1* | 6/2015 | Kupanoff | F41C 23/14<br>42/73 |
| 2015/0338186 | A1* | 11/2015 | Hopkins | F41C 23/14<br>42/73 |
| 2016/0116250 | A1* | 4/2016 | Mather | F41C 23/04<br>42/73 |
| 2016/0202016 | A1* | 7/2016 | Mather | F41C 23/14<br>42/73 |
| 2016/0327362 | A1* | 11/2016 | Eitan | F41C 23/02 |
| 2017/0205190 | A1* | 7/2017 | Jen | F41C 23/14 |

* cited by examiner

ADJUSTABLE FIREARM STOCK

CROSS-REFERENCE TO RELATED APPLICATION

This application claims the benefit of U.S. Provisional Patent Application No. 62/328,642 filed on Apr. 28, 2016, entitled "OPTIMUS PDW (PERSONAL DEFENSE WEAPON) STOCK," which is hereby incorporated by reference in its entirety for all that is taught and disclosed therein.

FIELD OF THE INVENTION

The present invention relates to firearms, and more particularly to a firearm stock with multiple extended positions and a collapsed position that attaches to two points on the rear of a lower receiver.

BACKGROUND OF THE INVENTION

A firearm stock is the portion of a rifle or other firearm that is held against the user's shoulder when discharging the firearm. The stock enables the user to firmly support the firearm and aim it accurately. The stock also conveys recoil to the user's body.

Because the stock's length determines the pull length (the distance from the user's shoulder to the trigger) and can be a significant factor in the overall length of the firearm, a collapsible stock that provides multiple different pull lengths in several extended positions and a compact collapsed position is highly desirable. The ability to adjust the pull length accommodates individual user's preferences, along with varying thickness of body armor and other attire. The collapsed position that decreases the overall length of the firearm also facilitates firearm operation in confined spaces and enables more compact storage of the firearm when the firearm is not in use. A firearm with a shorter stock when stored can also enable the use of standard length storage containers even when accessories that increase the overall length of the firearm, such as a suppressor, are installed.

Although many folding and adjustable firearm stocks are known, they often have the disadvantage of requiring professional installation. Some prevent the firearm from being discharged when in their folded or collapsed position. Others do not precisely fit the host firearm or can loosen over time from recoil forces, thereby adversely affecting accuracy and/or conveying the appearance of a poor-fitting, low-quality stock even if the firearm's accuracy is not adversely affected.

Therefore, a need exists for a new and improved adjustable firearm stock with multiple extended positions and a collapsed position that attaches to two points on the rear of a lower receiver. In this regard, the various embodiments of the present invention substantially fulfill at least some of these needs. In this respect, the adjustable firearm stock according to the present invention substantially departs from the conventional concepts and designs of the prior art, and in doing so provides an apparatus primarily developed for the purpose of enabling the stock to have multiple extended positions and a collapsed position that attaches to two points on the rear of a lower receiver.

SUMMARY OF THE INVENTION

The present invention provides an improved adjustable firearm stock, and overcomes the above-mentioned disadvantages and drawbacks of the prior art. As such, the general purpose of the present invention, which will be described subsequently in greater detail, is to provide an improved adjustable firearm stock that has all the advantages mentioned above.

To attain this, the preferred embodiment of the present invention essentially comprises a frame having a forward extending barrel defining a barrel axis and defining an elongated passage adapted to receive a reciprocating bolt, the frame having a first attachment facility registered with the barrel axis and adapted to receive a buffer tube defining a cavity adapted to receive a buffer spring operable to interact with the bolt, the frame having second attachment facility spaced apart from the barrel axis and from the first attachment facility, a telescoping stock defining a sleeve bore coaxial with the barrel axis and closely and slidably receiving the buffer tube, the stock defining a second bore parallel to and laterally offset from the first bore, an elongated support element slidably received in the second bore, and the support element having a forward end operable to removably engage the second attachment facility. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
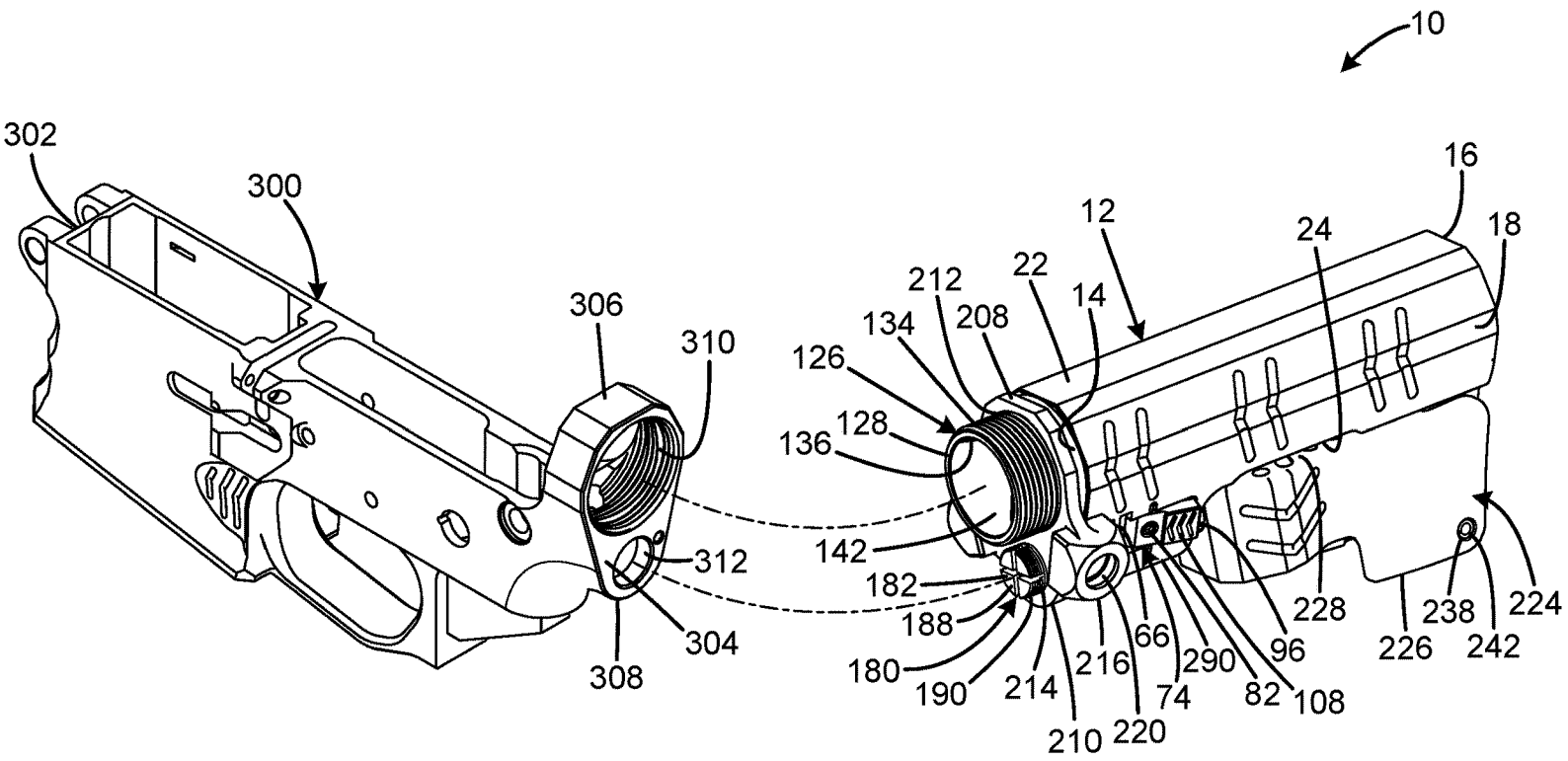
FIG. 1 is a front isometric view of the current embodiment of the adjustable firearm stock constructed in accordance with the principles of the present invention illustrating how the adjustable firearm stock is attached at two points to the lower receiver of a firearm.
Figure 2:
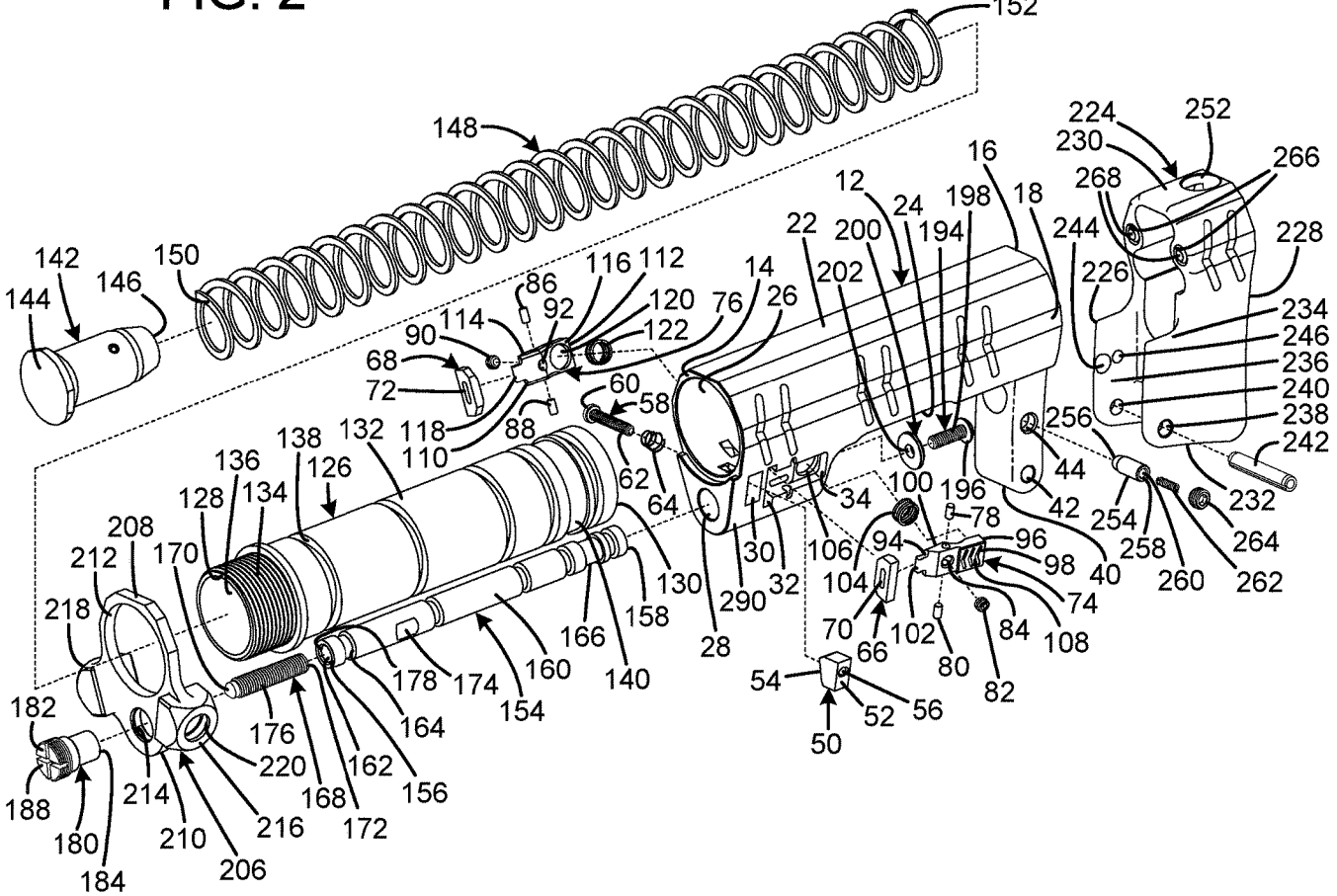
FIG. 2 is an exploded view of the current embodiment of the adjustable firearm stock of FIG. 1.
Figure 3:
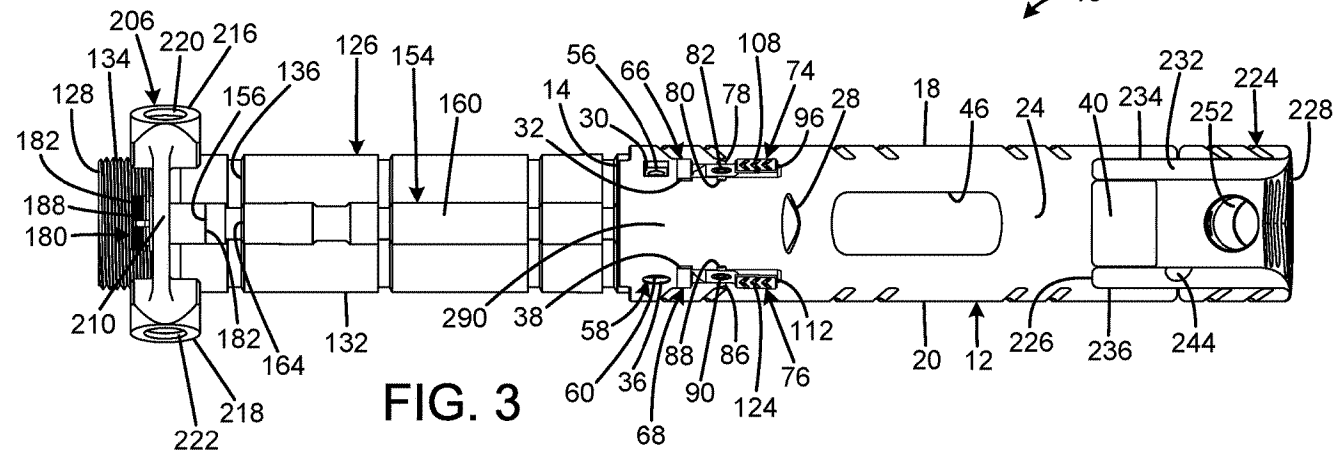
FIG. 3 is a bottom view of the current embodiment of the adjustable firearm stock of FIG. 1 with the positional lock levers in the unlocked position.
Figure 4:
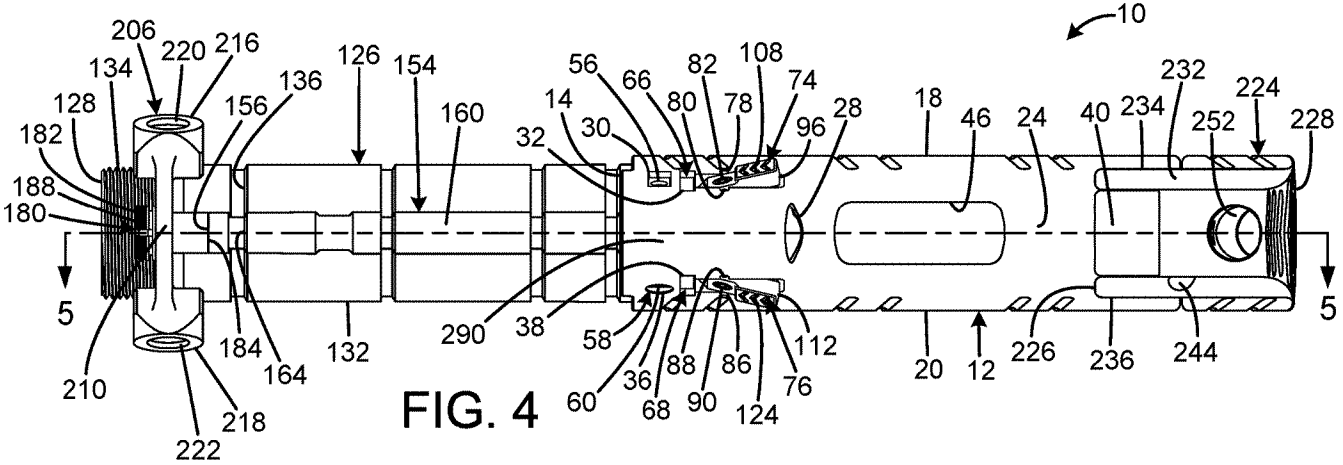
FIG. 4 is a bottom view of the current embodiment of the adjustable firearm stock of FIG. 1 with the positional lock levers in the locked position.
Figure 5:
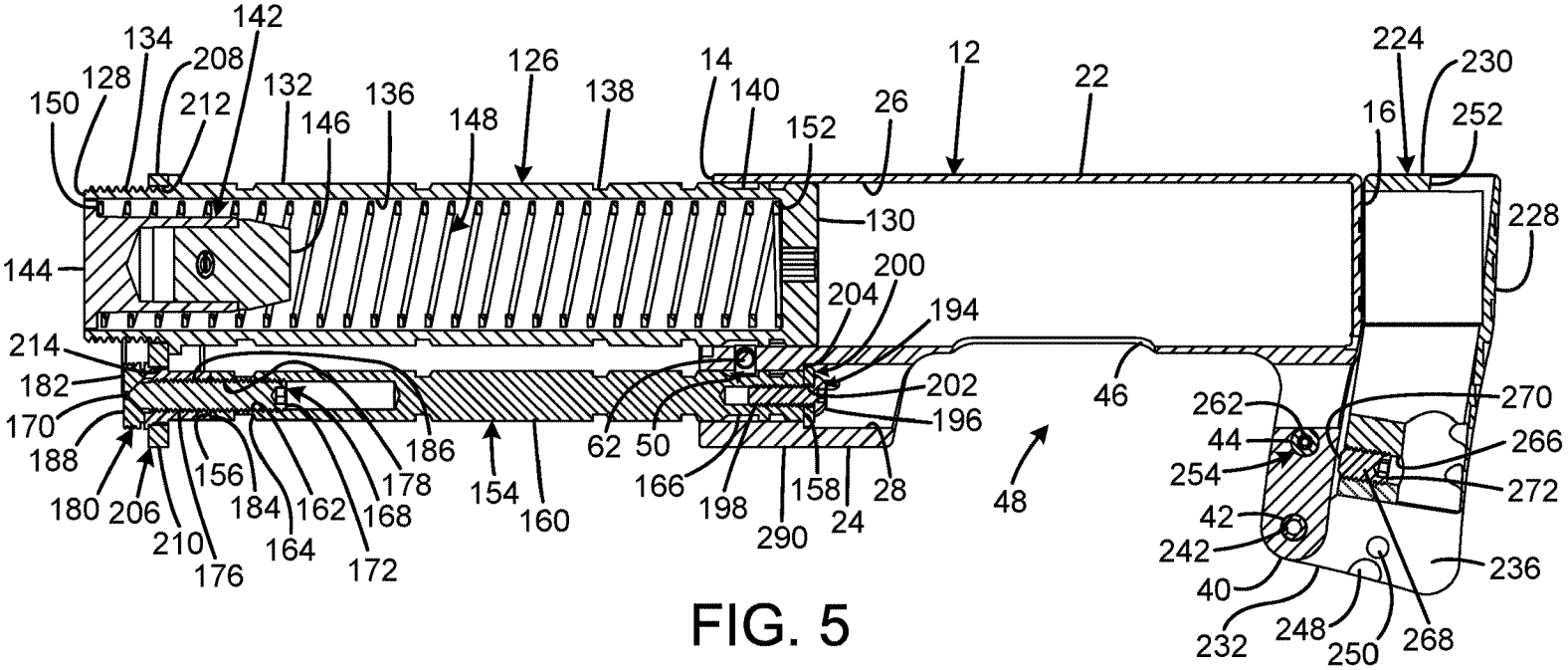
FIG. 5 is a side sectional view of the current embodiment of the adjustable firearm stock of FIG. 1 with the stock body in the maximally extended position and the flip extension in the extended position.

An embodiment of the adjustable firearm stock of the present invention is shown and generally designated by the reference numeral 10.

FIGS. 1-5 illustrate the improved adjustable firearm stock 10 of the present invention. More particularly, the stock includes a body 12 having a front 14, rear 16, left side 18, right side 20, top 22, and bottom 24. The front of the body defines a buffer tube bore 26 and a downwardly protruding front extension 290. The front extension defines a front guide rod bore 28 that penetrates through the front extension. The left side of the front extension defines a stop aperture 30, lock aperture 32, and a return spring recess 34. The right side of the front extension defines a stop retaining screw aperture 36, lock aperture 38, and a return spring recess (not visible). The rear of the body defines a hinge extension 40 that defines a hinge pin bore 42 and a detent bore 44 that is located above the hinge pin bore. The bottom of the body defines a window 46 to provide clearance for a flip extension 224 and a place for debris to go located above a flip extension space 48 defined between the front extension and the hinge extension.

A spring-loaded stop 50 having a front 52, a rear 54, and defining a threaded aperture 56 is slidably received within the stop aperture. A stop retaining screw having a head 60 and a threaded portion 62 is received within the stop retaining screw aperture. The threaded portion receives a spring 64 and is threadedly engaged within the threaded aperture of the spring-loaded stop. The left lock aperture 32 receives a positional lock 66 that has a central vertical slot 70. The right lock aperture 38 receives a positional lock 68 that has a central vertical slot 72. A left positional locking lever 74 is pivotally attached to the left side 18 of the stock body 12 by pivot pins 78, 80 and a retaining set screw 82 threadedly engaged with a threaded aperture 84 in the left positional locking lever. A right positional locking lever 76 is pivotally attached to the right side 20 of the stock body by pivot pins 86, 88 and a retaining set screw 90 threadedly engaged with a threaded aperture 92 in the right positional locking lever.

The left positional locking lever 74 has a front 94, rear 96, top 98, and bottom 100. The front defines a narrow nose 102 that is received within the slot 70 of the left positional lock 66. The bottom of the left positional locking lever defines a recess (not visible) that captures one end of a return spring 104. The opposed end of the return spring is captured within a return spring recess 106 defined by the left side 18 of the stock body 12. The top rear of the left positional locking lever defines serrations 108 to facilitate depression of the rear of the left positional locking lever to place the left positional lock into the unlocked position. The return spring biases the left positional locking lever and left positional lock into the locked position.

The right positional locking lever 76 has a front 110, rear 112, top 114, and bottom 116. The front defines a narrow nose 118 that is received within the slot 72 of the right positional lock 68. The bottom of the right positional locking lever defines a recess 120 that captures one end of a return spring 122. The opposed end of the return spring is captured within a return spring recess (not visible) defined by the right side 20 of the stock body 12. The top rear of the right positional locking lever defines serrations 124 to facilitate depression of the rear of the right positional locking lever to place the right positional lock into the unlocked position. The return spring biases the right positional locking lever and right positional lock into the locked position.

The buffer tube bore 26 defined by the front 14 of the stock body 12 receives a buffer tube 126. The buffer tube has a front 128, rear 130, and exterior 132. The front includes a threaded portion 134 and defines a central bore 136. The exterior defines a plurality of positional grooves 138 and a stop groove 140. In the current embodiment, the positional grooves are narrower than the width of the spring-loaded stop 50, and the stop groove is wider than the width of the spring-loaded stop. As a result, the spring-loaded stop slides over the positional grooves when the stock body is slid longitudinally between the collapsed position and the maximally extended position, and the spring-loaded stop protrudes into the stop groove to define the maximally extended position and prevent unintentional removal of the buffer tube from the buffer tube bore. A buffer 142 having a front head portion 144 and a tapered rear portion 146 is received within the central bore of the buffer tube. A buffer spring 148 is received within the central bore of the buffer tube with a front end 150 contacting the rear of the buffer and a rear end 152 contacting the rear of the buffer tube.

The guide rod bore 28 defined by the front extension 290 of the stock body 12 receives a guide rod 154. The guide rod has a front 156, rear 158, and exterior 160. The front defines a central bore 162. The exterior defines a plurality of positional grooves 164 and a stop groove 166. In the current embodiment, the positional grooves are narrower than the width of the spring-loaded stop 50, and the stop groove is wider than the width of the spring-loaded stop. As a result, the spring-loaded stop slides over the positional grooves when the stock body is slid longitudinally between the collapsed position and the maximally extended position, and the spring-loaded stop protrudes into the stop groove to define the maximally extended position and prevent unintentional removal of the guide rod from the guide rod bore. The guide rod's positional grooves and stop groove are registered with the buffer tube's positional grooves 138 and stop groove 140 to establish the adjustment positions of the stock 10. The rear 172 of a set screw 168 having an exterior threaded portion 176 is received within a threaded portion 178 at the front of the central bore. Flats 174 defined by the exterior of the guide rod enable an open-ended wrench to be used to tighten the guide rod onto the set screw. The guide rod prevents flexing and pivoting of the stock body with respect to the buffer tube 126, particularly when the stock body is in an extended position.

An expanding mandrel 180 having a front 182 and a rear 184 receives the front 170 of the set screw 168 within a threaded rear aperture 186. The front of the expanding mandrel defines four petals 188 and a threaded portion 190 on the petals. In the current embodiment, the threaded portion can be concentric ridges or helical threads. The underside of the petals defines a conical space with sides at a 45° angle, and the front of the set screw includes a matching conical protrusion with sides at a 45° angle.

The rear 158 of the guide rod 154 defines a threaded aperture 192. A washer retention screw 194 having a head 196 and a threaded portion 198 threadedly attaches a washer stop 200 having a central aperture 202 to the rear of the guide rod. The washer stop engages a shoulder 204 within the guide rod bore 28 defined by the front extension 290 to limit longitudinal forward movement of the guide rod.

An end plate 206 having a top 208 and a bottom 210 defines an upper buffer tube aperture 212 and a lower mandrel aperture 214 that receive the threaded portion 134 of the buffer tube 126 and the front 182 of the expanding mandrel 180, respectively. In the current embodiment, the expanding mandrel is threadedly engaged and glued to the end plate to ensure permanent attachment. Alternatively, the expanding mandrel and the end plate can be manufactured as a unitary part. The endplate also includes a left ear 216 and a right ear 218. The left ear defines an aperture 220, and the right ear defines an aperture 222 The apertures are quick disconnects for sling attachments.

A flip extension 224 having a front 226, rear 228, top 230, and bottom 232 is pivotally attached to the hinge extension 40 on the stock body 12. The bottom of the flip extension defines left and right hinge plates 234, 236. Each of the hinge plates defines a hinge pin aperture 238, 240. A hinge pin 242 is received within the hinge pin apertures and a hinge pin bore 42 defined by the hinge extension to pivotally attach the flip extension to the hinge extension. The front of the right hinge plate defines a first detent ramp 244 and an adjacent first detent recess 246, and the bottom of the right hinge plate defines a second detent ramp 248 and an adjacent second detent recess 250. The top of the flip extension defines a guide rod aperture 252. The front 226 of the flip extension defines three set screw bores 266 (two upper visible in FIG. 2 and one lower visible in FIG. 5). Each of the set screw bores receives a flip extension set screw 268 having a front 270 and a rear 272. The extended position of the flip extension can be finely adjusted by extending a portion of the front of the two upper flip extension set screws to contact the rear 16 of the stock body and extending a portion of the front of the lower flip extension set screw to contact the hinge extension 40 when the flip extension is in the extended position.

A detent 254 having a front 256, rear 258, and rear aperture 260 is received within the detent bore 44 in the hinge extension 40 on the stock body 12. The rear aperture of the detent receives one end of a detent spring 262, and the opposing end of the detent spring abuts a detent spring retaining screw 264. When the flip extension 224 is rotated into the extended position, the front of the detent slides over the first detent ramp 244 and is received by the first detent recess 246 to releasably secure the flip extension in the extended position. When the flip extension is rotated into the stowed position, the front of the detent slides over the second detent ramp 248 and is received by the second detent recess 250 releasably secure the flip extension in the extended position. When the flip extension is in the stowed position and the stock body 12 is in the collapsed position, the rear 158 of the guide rod 154 is received within the guide rod aperture 252 in the top 230 of the flip extension to prevent the flip extension from being rotated into the extended position.

FIG. 1 shows the adjustable shoulder stock 10 in the process of being connected to a lower receiver 300. More particularly, the lower receiver has a front 302, rear 304, top 306, and bottom 308. The rear of the lower receiver defines an upper threaded aperture 310 and a lower smoothbore aperture 312. To attach the adjustable shoulder stock to the lower receiver, the endplate/mandrel assembly 206 is first slid onto the lower receiver. Then, the threaded portion 134 of the buffer tube 126 is put through the endplate into the upper threaded aperture of the lower receiver and hand tightened. The set screw 168 is subsequently screwed into the mandrel and tightened, to expand the petals 188 of the expanding mandrel 180 within the lower smoothbore aperture in the rear of the lower receiver. Because of the expanding mandrel functioning as a reverse collet, the threaded portion 190 of the petals bites into the rear of the lower receiver to provide a second attachment point for the adjustable shoulder stock. As a result, the adjustable shoulder stock is stiffened against vertical flexing in addition to being inhibited from rotating. The buffer tube is then tightened securely to the receiver. Once this is done, the stock body 12 is slid on, and then the guide rod is attached.

Figure 6:
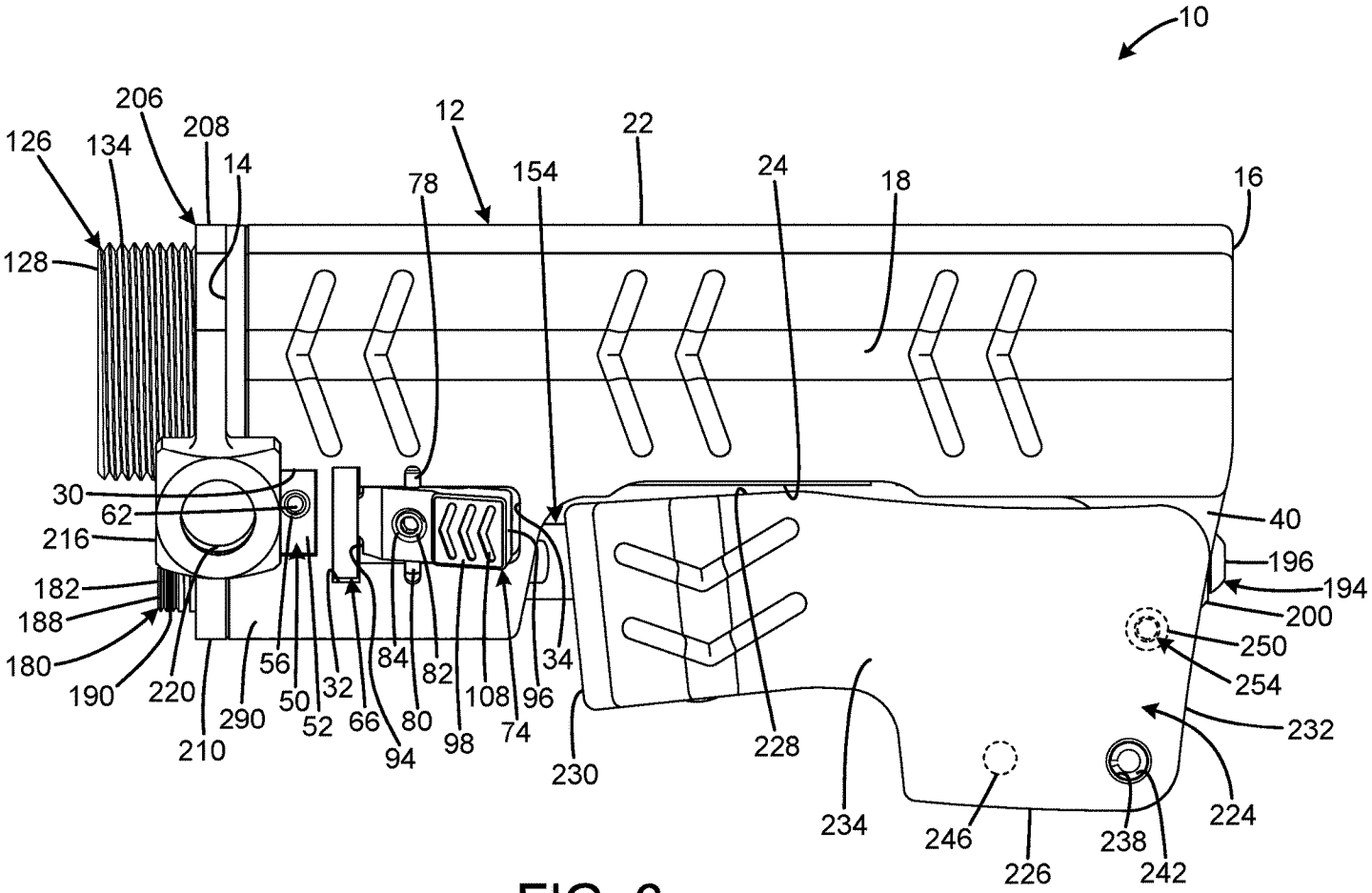
FIG. 6 is a left side view of the current embodiment of the adjustable firearm stock of FIG. 1 with the stock body in the collapsed position and the flip extension in the stowed position.
Figure 7:
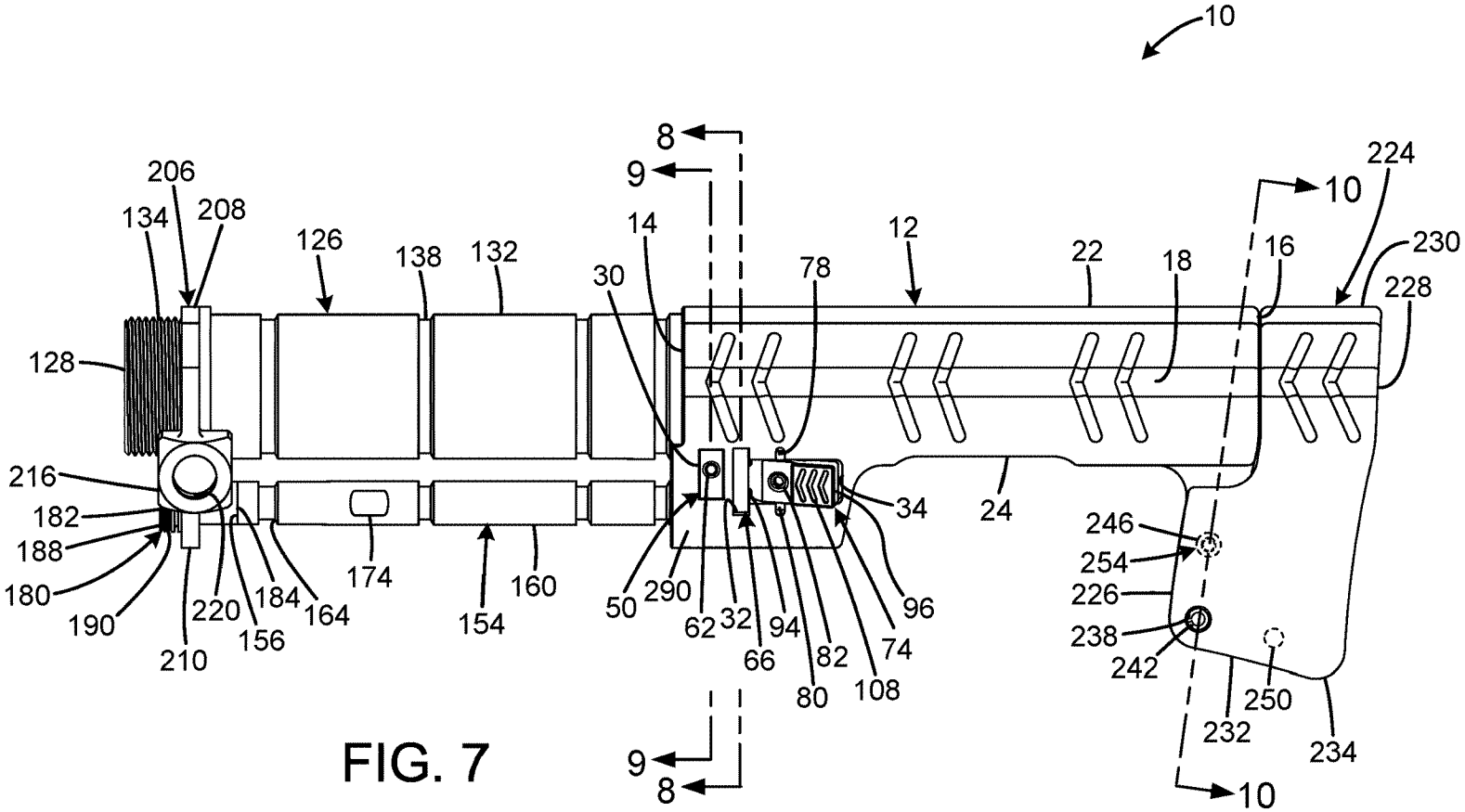
FIG. 7 is a left side view of the current embodiment of the adjustable firearm stock of FIG. 1 with the stock body in the maximally extended position and the flip extension in the extended position.
Figure 10:
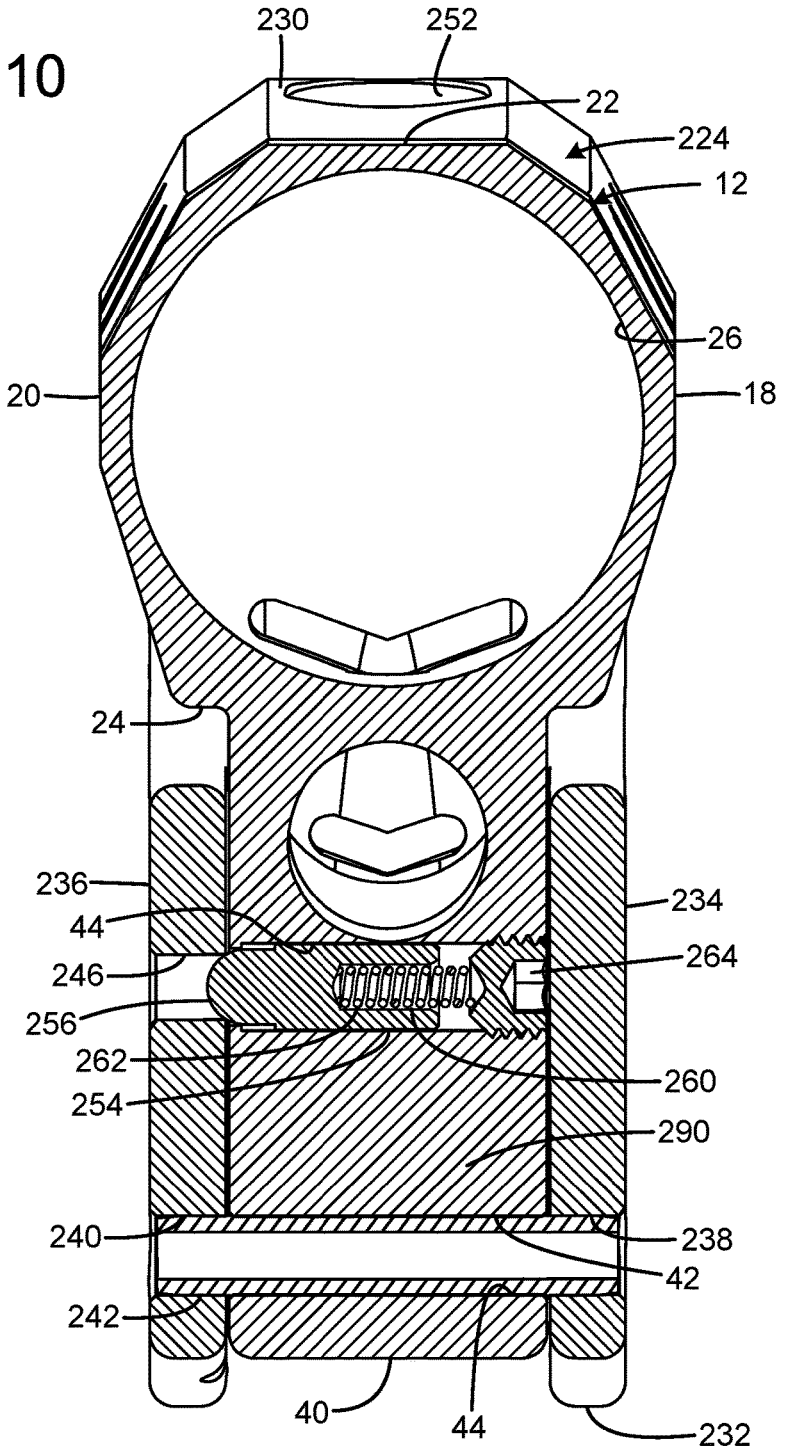
FIG. 10 is a sectional view of the current embodiment of the adjustable firearm stock of FIG. 1 taken along line 10-10 of FIG. 7.

FIGS. 6, 7, and 10 illustrate how the second detent recess 250 receives the front 256 of the detent 254 when the flip extension 224 is in the stowed position (FIG. 6) and how the first detent recess 246 receives the front of the detent when the flip extension is in the extended position (FIGS. 7 and 10).

Figure 8:
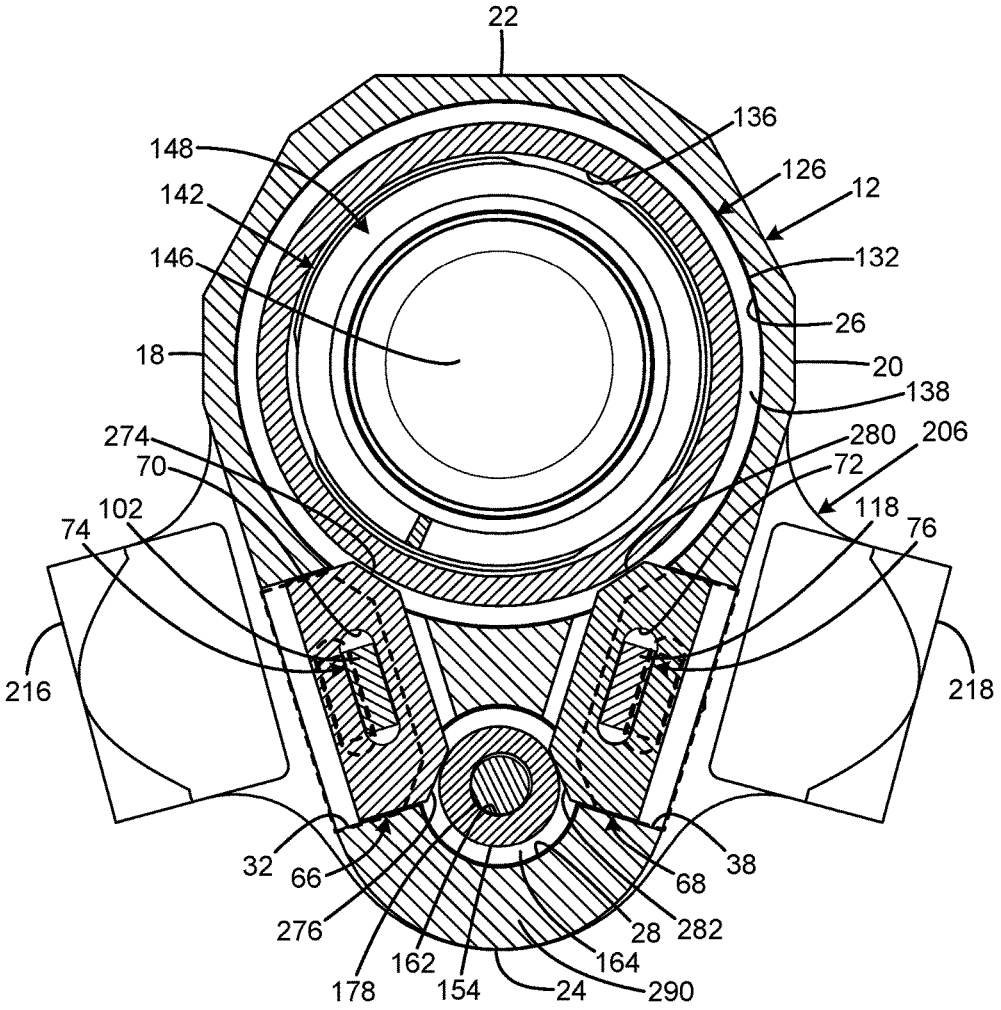
FIG. 8 is a sectional view of the current embodiment of the adjustable firearm stock of FIG. 1 taken along line 8-8 of FIG. 7.

FIG. 8 illustrates how the left positional lock 66 and right positional lock 68 interact with the positional grooves 138 on the exterior 132 of the buffer tube 126 and the positional grooves 164 on the exterior 160 of the guide rod 154. More particularly, the left positional lock has a top angled portion 274 and a bottom angled portion 276, and the right positional lock has a top angled portion 280 and a bottom angled portion 282. The top angled portions of the positional locks engage a selected positional groove on the exterior of the buffer tube to prevent longitudinal movement of the stock body 12 relative to the buffer tube. The bottom angled portions of the positional locks engage a selected positional groove on the exterior of the guide rod to prevent longitudinal movement of the stock body relative to the guide rod. To slide the stock body longitudinally into one of the five positions determined by the positional grooves, the angled portions of the positional locks must be disengaged from the positional grooves. To disengage the positional locks, the left and right positional locking levers 74, 76 must be simultaneously depressed and held so that their front noses 102, 118 push outwards within the slots 70, 72 to displace the positional locks from the positional grooves. Once the stock body has been slid to the desired position, the positional locking levers are released so the positional locks engage the newly selected positional grooves to releasably secure the stock body in longitudinal position relative to the buffer tube and guide rod.

Figure 9:
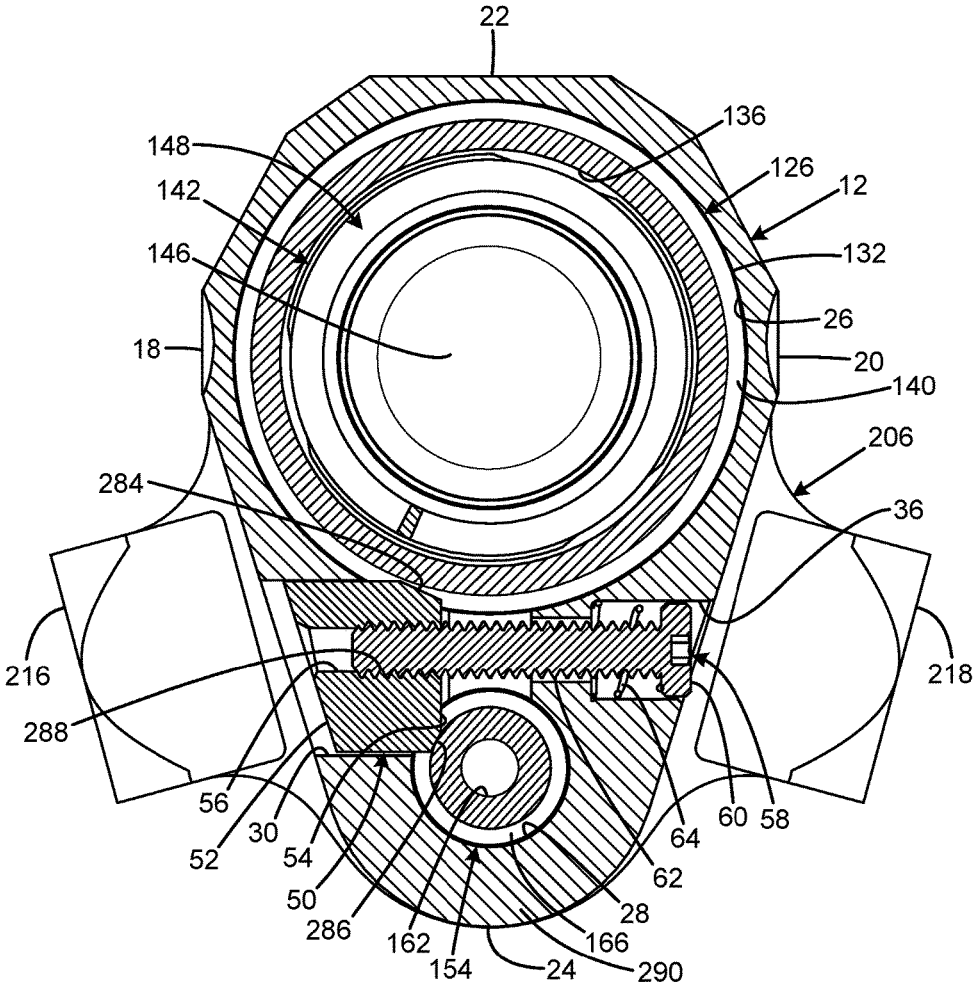
FIG. 9 is a sectional view of the current embodiment of the adjustable firearm stock of FIG. 1 taken along line 9-9 of FIG. 7.

FIG. 9 illustrates how the spring-loaded stop 50 interacts with the stop groove 140 on the exterior 132 of the buffer tube 126 and the stop groove 166 on the exterior 160 of the guide rod 154. More particularly, the spring-loaded stop 50 has a top angled portion 284, a bottom angled portion 286, and a threaded portion 288 of the aperture 56. The top angled portion engages the stop groove on the exterior of the buffer tube to prevent removal of the buffer tube from the buffer tube bore 26 in the stock body 12. The bottom angled portion engages the stop groove on the exterior of the guide rod to prevent removal of the guide rod from the guide rod bore 28 in the stock body. The threaded portion 62 of the stop retaining screw 58 threadedly engages the threaded portion 288 of the aperture 56 to attach the spring-loaded stop to the stop retaining screw.

To remove the stock body 12 from the buffer tube 126 and guide rod 154, the washer retaining screw 194 and washer stop 200 are detached from the rear 158 of the guide rod. Subsequently, the stop retaining screw 58 and the positional locking levers 74, 76 must all be depressed and held simultaneously to enable the stock body to be slid off the rears of the buffer tube and guide rod.

While a current embodiment of an adjustable firearm stock has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm comprising:

a frame having a first attachment facility adapted to receive a buffer tube defining a cavity adapted to receive a buffer spring operable to interact with a bolt;

the frame having second attachment facility spaced apart from the first attachment facility;

a telescoping stock defining a buffer tube bore closely and slidably receiving the buffer tube;

the stock defining a guide rod bore parallel to and laterally offset from the buffer tube bore;

an elongated support element slidably received in the guide rod bore;

the support element having a forward end operable to removably engage the second attachment facility; and wherein the forward end of the support element is expandable laterally between a reduced-width condition and an enlarged-width condition, wherein the reduced width condition enables insertion and removal of the forward end from the second attachment facility, and the enlarged width condition engages the second attachment facility to secure the support element to the frame.

2. The firearm of claim 1 wherein the first and second attachment facilities are located at a rear face of the frame.

3. The firearm of claim 2 wherein the first attachment facility is a threaded bore, and the second attachment facility is a pocket which is spaced apart from the first attachment facility.

4. The firearm of claim 3 wherein the pocket is a cylindrical recess having a depth less than its diameter.

5. The firearm of claim 1 wherein the forward end of the support element is divided into a plurality of flexible petals.

6. The firearm of claim 5 wherein the support element includes a set screw operably engaged to the petals to selectably spread the petals to engage the second attachment facility.

7. The firearm of claim 1 wherein the forward end of the support element is an expanding mandrel.

8. The firearm of claim 7 wherein the expanding mandrel includes concentric ridges adapted to grip a contact surface of the second attachment facility.

9. The firearm of claim 7 wherein the expanding mandrel has a threaded portion that includes concentric ridges.

10. An adjustable stock for a firearm having a frame with a buffer tube extending in a rearward direction, and a pocket defined in the frame adjacent to the buffer tube, and open to the rearward direction, the stock comprising:

a body defining a first bore adapted to closely and slidably receive the buffer tube;

the stock defining a second bore parallel to and laterally offset from the first bore;

an elongated support element slidably received in the second bore;

the support element having a forward end operable to removably engage the pocket; and wherein the pocket is a cylindrical recess having a depth less than its diameter.

11. The stock of claim 10 wherein the pocket is defined in a rear face of the frame, the rear face facing the rearward direction.

12. The stock of claim 10 wherein the forward end of the support element is expandable laterally between a reduced-width condition and an enlarged-width condition, wherein the reduced width condition enables insertion and removal of the forward end from the pocket, and the enlarged width condition engages the pocket to secure the support element to the frame.

13. The stock of claim 10 wherein the forward end of the support element is divided into a plurality of flexible petals.

14. The stock of claim 13 wherein the support element includes a set screw operably engaged to the petals to selectably spread the petals to engage the second attachment facility.

15. The stock of claim 14 wherein the set screw is received in a threaded bore in the support element.

16. The stock of claim 10 wherein the forward end of the support element is an expanding mandrel.

17. The stock of claim 16 wherein the expanding mandrel includes concentric ridges adapted to grip a contact surface of the pocket.

18. The stock of claim 16 wherein the expanding mandrel has a threaded portion that includes concentric ridges.

* * * * *